US011014149B2

(12) United States Patent
Huber et al.

(10) Patent No.: US 11,014,149 B2
(45) Date of Patent: May 25, 2021

(54) INGOT MOLD AND METHOD FOR PRODUCING A COMPONENT

(71) Applicant: Bayerische Motoren Werke Aktiengesellschaft, Munich (DE)

(72) Inventors: Manfred Huber, Rottenburg (DE); Thomas Summer, Hohenthann (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/740,241

(22) Filed: Jan. 10, 2020

(65) Prior Publication Data

US 2020/0147678 A1 May 14, 2020

Related U.S. Application Data

(63) Continuation of application No. PCT/EP2018/065801, filed on Jun. 14, 2018.

(30) Foreign Application Priority Data

Jul. 12, 2017 (DE) ..... 10 2017 211 876.8

(51) Int. Cl.

| | |
|---|---|
| ***B22C 9/10*** | (2006.01) |
| ***B22C 9/22*** | (2006.01) |
| ***B22D 15/02*** | (2006.01) |

(52) U.S. Cl.

CPC ..... *B22D 15/02* (2013.01); *B22C 9/108* (2013.01); *B22C 9/22* (2013.01)

(58) Field of Classification Search

CPC ..... B22C 9/06; B22C 9/103; B22C 9/108; B22C 9/22; B22D 15/02

See application file for complete search history.

(56) References Cited

U.S. PATENT DOCUMENTS

| | | | | |
|---|---|---|---|---|
| 5,720,240 | A | 2/1998 | Dohn et al. | |
| 6,662,857 | B2 | 12/2003 | Willfort et al. | |
| 6,666,254 | B2 | 12/2003 | Voigt et al. | |
| 2002/0185248 | A1 | 12/2002 | Shade | |
| 2007/0012271 | A1 | 1/2007 | Hilpert | |
| 2016/0038995 | A1* | 2/2016 | Fent | B22D 25/02 164/138 |
| 2017/0241370 | A1* | 8/2017 | Kusaka | B22C 9/108 |

FOREIGN PATENT DOCUMENTS

| | | | |
|---|---|---|---|
| CN | 1323667 | A | 11/2001 |
| CN | 202984579 | U | 6/2013 |
| CN | 202984580 | U | 6/2013 |
| CN | 105246617 | A | 1/2016 |

(Continued)

OTHER PUBLICATIONS

PCT/EP2018/065801, International Search Report dated Jul. 17, 2018 (Three (3) pages).

(Continued)

*Primary Examiner* — Kevin E Yoon

(74) *Attorney, Agent, or Firm* — Crowell & Moring LLP

(57) ABSTRACT

A mold includes an ingot mold and a top core. The top core is disposed in and/or on the ingot mold. The top core forms, in part, a functional surface of a component formed in the mold and the ingot mold forms at least a sub-region of the functional surface of the component formed in the mold.

10 Claims, 1 Drawing Sheet

(56) References Cited

FOREIGN PATENT DOCUMENTS

| | | | |
|---|---|---|---|
| CN | 106029253 | A | 10/2016 |
| DE | 195 42 492 | C1 | 1/1997 |
| DE | 20 2004 020 207 | U1 | 4/2005 |
| DE | 10 2004 046 962 | A1 | 4/2006 |
| DE | 20 2005 010 449 | U1 | 11/2006 |
| DE | 10 2010 025 285 | A1 | 12/2011 |
| DE | 10 2013 214 534 | A1 | 1/2015 |
| DE | 10 2014 101 080 | B3 | 7/2015 |
| DE | 10 2014 202 034 | A1 | 8/2015 |
| EP | 0 933 151 | A1 | 8/1999 |
| JP | 2000-33459 | A | 2/2000 |
| JP | 2013-52415 | A | 3/2013 |
| JP | 2013-86117 | A | 5/2013 |
| KR | 10-2009-0058838 | A | 6/2009 |

OTHER PUBLICATIONS

English-language Chinese Office Action issued in Chinese application No. 201880037012.8 dated Dec. 1, 2020 (Seven (7) pages).

* cited by examiner

INGOT MOLD AND METHOD FOR PRODUCING A COMPONENT

CROSS REFERENCE TO RELATED APPLICATIONS

This application is a continuation of PCT International Application No. PCT/EP2018/065801, filed Jun. 14, 2018, which claims priority under 35 U.S.C. § 119 from German Patent Application No. 10 2017 211 876.8, filed Jul. 12, 2017, the entire disclosures of which are herein expressly incorporated by reference.

BACKGROUND AND SUMMARY OF THE INVENTION

The present invention relates to an ingot mold, in particular for a cylinder head of an internal combustion engine, to a method for producing a component, in particular a cylinder head, and to the use of an ingot mold.

Ingot molds are reusable molds for casting metals and alloys. Cores are also required here in order for it to be possible for cavities and/or undercuts to be made in the castings which are to be produced. These cores often consist of sand and, accordingly, can be used only once. This increases the processing costs. Added to this is the fact that the cores, in particular the sand cores, influence the solidification of the melt as a result of their insulating effect, and it is therefore possibly the case that optimally directed solidification cannot be realized.

It is therefore an object of the present invention to specify an ingot mold, a method for producing a component, and the use of an ingot mold, which overcome the aforementioned disadvantages and are suitable, in particular, for producing cylinder heads for internal combustion engines.

The invention provides an ingot mold for a cylinder head of an internal combustion engine, wherein a top core is, or can be, arranged in and/or on the ingot mold and forms, in part, a functional surface of a component, in particular of a cylinder head, and wherein the ingot mold is designed to form, or to help to form, at least a sub-region of the functional surface. What is said hereinbelow applies, in particular, to a cylinder head of an internal combustion engine. However, the ingot mold, the method and the use are envisaged for, and can be applied to, the production of a wide variety of different parts or castings. Typical casting methods are, for example, gravity casting or low-pressure casting, wherein the materials used are preferably steel and, in particular, aluminum or aluminum alloys, for example also aluminum/magnesium alloys. The great advantage here is that the functional surface of the component, rather than being formed exclusively via the top core or via the ingot mold, is formed, as it were, by interaction of the ingot mold with the top core. This advantageously makes it possible to reduce the size of the top core to a minimum, which has a direct effect on the production costs since, accordingly, less molding material is required for the top core, which is produced preferably from sand.

According to a preferred embodiment, the functional surface is a cover flange of a cylinder head. The cover flange is intended to mean, in particular, that surface of the cylinder head which is oriented in the direction of the (subsequent) valve cover. The top core is advantageously configured, or designed, such that it forms merely a contour of the cover flange, whereas the other regions of the cover flange are reproduced by the ingot mold, in other words therefore by the permanent mold.

According to a preferred embodiment, the functional surface is a (subsequent) sealing surface of a casting. Further preferably, the functional surface has an open or closed progression. Particularly preferably, the surface is in meandering form or has curves, radii, bends, etc., and/or also rectilinear portions.

The ingot mold preferably has, or comprises, two movably arranged, in particular swing-action or pivotable, (permanent) molding parts, which can be displaced laterally in the direction of the top core. The top core can expediently thus be fixed straightforwardly between the molding parts, wherein according to one embodiment first of all the top core is arranged in place and then the two molding parts are swung downward. It should be mentioned here that, alongside the top core, other cores, e.g., a water-jacket core and an oil-chamber core, cores for the inlet and outlet channels, etc., are expediently, or can expediently be, arranged in the ingot mold. The cores are positioned, in particular, beneath the top core.

According to one embodiment, for the purpose of forming the functional surface, the top core and the molding parts have molding surfaces, which merge one inside the other without any offset. This expediently forms a stepless functional surface, in particular a planar cover-flange surface. As an alternative, it is also possible for an offset to be provided between the molding surfaces of the molding parts and the top core if required by the geometry of the functional surface.

According to one embodiment, a length of the top core corresponds to a length of the component along a longitudinal direction (of the component). This means that the top core is as long as the component, but at the same time advantageously has a width which is considerably smaller than the width of the component, since the ingot mold is provided here, in particular the two movably arranged molding parts thereof so to speak flank the top core here. As an alternative, the top core spans just part of a component length and the overall width thereof. As a further alternative, the top core spans neither the length nor the width of the component in full; rather, it is flanked on all sides by (permanent) molding parts.

According to one embodiment, the top core has a multiplicity of cylindrical or essentially cylindrical, or even conically tapering, feeders. The narrow top core, comprising the feeders, advantageously makes it possible to provide for solidification directed toward the same.

The feeders are preferably arranged one after the other along the longitudinal direction of the component, in particular of the cylinder head. This provides for optimum and uniform mold filling. In addition, the feeder volume can be kept very small. The minimal size of the top core means that the latter does not have an insulating effect, and optimally directed solidification in the direction of the feeders is made possible.

According to one embodiment, the top core has at least one molding element which is designed to form a bearing location in the functional surface, in particular a bearing tunnel in the cover flange. Rather than being completely flat or planar, the molding surface of the top core therefore expediently can have protrusions and/or set-back portions, in order for any additional geometries or shapes to be integrated in the functional surface. The bearing tunnel serves, in particular, to hold, and to bear, a camshaft.

According to one embodiment, at least one of the molding parts has at least one molding element which is designed to form a bearing location in the functional surface, in particular a bearing tunnel in the cover flange. What has been said in relation to the molding element of the top core applies here.

The invention is also directed to a method for producing a component, in particular a cylinder head of an internal combustion machine, comprising the following steps:

supplying an ingot mold and a top core; and forming a functional surface of a component by the top core and, at least to some extent, by the ingot mold.

The advantage is that the or a functional surface of a component is formed, at the same time, by the ingot mold and a core, in particular a top core. This approach makes it possible for the top core, which is expediently formed from molding sand, to be formed to be as small as necessary and for the ingot molds and the corresponding molding parts of the ingot mold to be formed to be as large as possible.

The invention is also directed to the use of an ingot mold according to the invention or of a method according to the invention in the production of motor vehicles.

The advantages and features mentioned in conjunction with the ingot mold apply analogously and correspondingly to the method and to the use, and vice versa.

Further advantages and features can be gathered from the following description of an ingot mold with reference to the accompanying figures.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
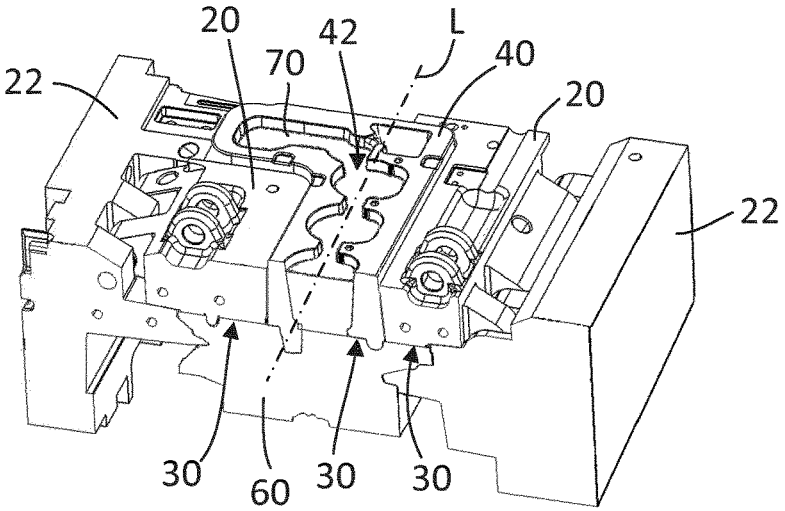
FIG. 1 shows a perspective view of an ingot mold along with a casting.

FIG. 1 shows a perspective view of an ingot mold (illustrated only to some extent) comprising two molding parts 22, in or on which two swing-action or pivotable molding parts 20 are mounted or positioned. Arranged between the latter molding parts is a top core 40, which has a multiplicity of feeders 42 arranged along a longitudinal direction L of a component, in this case, in particular, of a cylinder head 60. The mold, or ingot mold, is filled with casting material 70. It can be seen that the top core 40 and the pivotable molding parts 20 have molding surfaces 30, which form a common functional surface (cf. reference sign 62 in FIG. 2). The size, in particular the width, of the top core 40 is limited, so to speak, to a minimum.

Figure 2:
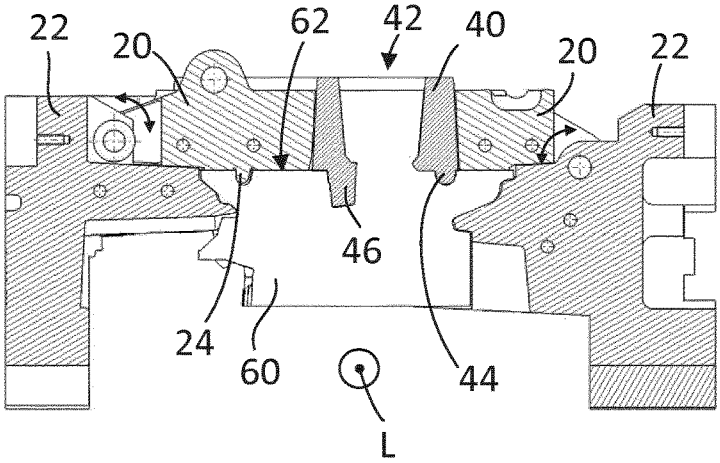
FIG. 2 shows a sectional illustration of the ingot mold from FIG. 1 along with the casting.

FIG. 2 shows a sectional illustration of the ingot mold which is known essentially from FIG. 1. The movement capability of the pivotable molding parts 20 is illustrated by way of the double arrows on the molding parts. It can be seen that the top core 40 has a protrusion 46, which forms a corresponding geometry in a subsequent casting. In addition, the top core 40 and the pivotable molding parts 20 have molding elements 24 and 44, which form a bearing tunnel 64 in the cylinder head 60, cf., in this respect, in particular also FIG. 3.

Figure 3:
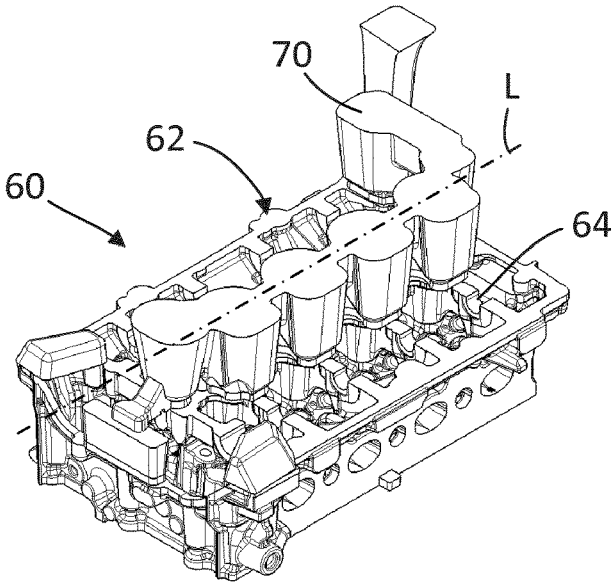
FIG. 3 shows a perspective view of a casting.

FIG. 3 shows the definitively cast and demolded cylinder head 60, it being possible to see, in particular, the functional surface 62 or the cover flange 62. In addition, the bearing tunnel 64, which serves to hold a camshaft, can be seen to good effect. It is clear, in particular, that the feeder volume is very small, and the ingot mold and the method provide for solidification which is optimally directed towards the feeders.

LIST OF REFERENCE CHARACTERS

20 Movable, swing-action molding part
22 Molding part
24 Molding element
30 Molding surface
40 Top core
42 Feeder
44 Molding element
46 Protrusion
60 Component, cylinder head
62 Functional surface, cover flange
64 Bearing tunnel
70 Casting material
L Longitudinal direction The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A mold, comprising:

an ingot mold; and a top core, wherein the top core is disposed in and/or on the ingot mold, wherein the top core forms, in part, a functional surface of a component formed in the mold, and wherein the ingot mold forms at least a sub-region of the functional surface of the component formed in the mold, wherein the ingot mold includes two molding parts which are displaceable laterally in a direction of the top core, and wherein the two molding parts are pivotable.

2. The mold according to claim 1, wherein the functional surface is a cover flange and wherein the component is a cylinder head.

3. The mold according to claim 1, wherein, for a purpose of forming the functional surface, the top core and the two molding parts have respective molding surfaces which merge one inside the other without any offset.

4. The mold according to claim 1, wherein at least one of the two molding parts has a second molding element which forms a second bearing location in the functional surface.

5. The mold according to claim 4, wherein the second bearing location is a second bearing tunnel, wherein the functional surface is a cover flange, and wherein the component is a cylinder head.

6. The mold according to claim 1, wherein a length of the top core corresponds to a length of the component along a longitudinal direction of the component.

7. The mold according to claim 1, wherein the top core has a plurality of cylindrical feeders.

8. The mold according to claim 7, wherein the plurality of cylindrical feeders are disposed one after the other along a longitudinal direction of the component.

9. The mold according to claim 1, wherein the top core has a first molding element which forms a first bearing location in the functional surface.

10. The mold according to claim 9, wherein the first bearing location is a first bearing tunnel, wherein the functional surface is a cover flange, and wherein the component is a cylinder head.

* * * * *